US009955250B2

(12) United States Patent
Hendrix et al.

(10) Patent No.: US 9,955,250 B2
(45) **Date of Patent: *Apr. 24, 2018**

(54) LOW-LATENCY MULTI-DRIVER ADAPTIVE NOISE CANCELING (ANC) SYSTEM FOR A PERSONAL AUDIO DEVICE

(71) Applicant: CIRRUS LOGIC, INC., Austin, TX (US)

(72) Inventors: Jon D. Hendrix, Wimberly, TX (US); Jeffrey Alderson, Austin, TX (US); Ali Abdollahzadeh Milani, Austin, TX (US); Dayong Zhou, Austin, TX (US); Yang Lu, Cedar Park, TX (US)

(73) Assignee: CIRRUS LOGIC, INC., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/202,644

(22) Filed: Jul. 6, 2016

(65) Prior Publication Data

US 2016/0316291 A1 Oct. 27, 2016

Related U.S. Application Data

(63) Continuation of application No. 13/968,007, filed on Aug. 15, 2013, now Pat. No. 9,414,150.
(Continued)

(51) Int. Cl.
*G10K 11/16* (2006.01)
*H04R 1/10* (2006.01)
(Continued)

(52) U.S. Cl.
CPC ..... *H04R 1/1083* (2013.01); *G10K 11/178* (2013.01); *G10K 11/1786* (2013.01);
(Continued)

(58) Field of Classification Search
CPC ..... H04R 1/1083; H04R 3/005; H04R 5/033; H04R 11/02; H04R 1/1016;
(Continued)

(56) References Cited

U.S. PATENT DOCUMENTS 4,020,567 A 5/1977 Webster
4,352,962 A 10/1982 LaMothe
(Continued)

FOREIGN PATENT DOCUMENTS

CN 101552939 A 10/2009
DE 102011013343 A1 9/2012
(Continued)

OTHER PUBLICATIONS

Wu, et al., "Decoupling feedforward and feedback structures in hybrid active noise control systems for uncorrelated narrowband disturbances", Journal of Sound and Vibration, vol. 350, Aug. 18, 2015, pp. 1-10, Elsevier.
(Continued)

*Primary Examiner* — Norman Yu
(74) *Attorney, Agent, or Firm* — Mitch Harris, Atty at Law, LLC; Andrew M. Harris

(57) ABSTRACT

A personal audio device including multiple output transducers for reproducing different frequency bands of a source audio signal, includes an adaptive noise canceling (ANC) circuit that adaptively generates an anti-noise signal for each of the transducers from at least one microphone signal that measures the ambient audio to generate anti-noise signals. The anti-noise signals are generated by separate adaptive filters such that the anti-noise signals cause substantial cancelation of the ambient audio at their corresponding transducers. The use of separate adaptive filters provides low-latency operation, since a crossover is not needed to split the anti-noise into the appropriate frequency bands. The
(Continued)

adaptive filters can be implemented or biased to generate anti-noise only in the frequency band corresponding to the particular adaptive filter. The anti-noise signals are combined with source audio of the appropriate frequency band to provide outputs for the corresponding transducers.

12 Claims, 4 Drawing Sheets

Related U.S. Application Data

(60) Provisional application No. 61/783,267, filed on Mar. 14, 2013.

(51) Int. Cl.
*G10K 11/178* (2006.01)
*H04R 3/12* (2006.01)
*H04R 1/24* (2006.01)
*H04R 3/00* (2006.01)

(52) U.S. Cl.
CPC ..... *H04R 1/24* (2013.01); *H04R 3/005* (2013.01); *H04R 3/12* (2013.01); *G10K 2210/1081* (2013.01); *G10K 2210/3019* (2013.01); *G10K 2210/3028* (2013.01); *H04R 2410/05* (2013.01); *H04R 2460/01* (2013.01)

(58) Field of Classification Search
CPC ..... H04R 2460/01; H04R 3/14; H04R 1/10; H04R 1/20; H04R 1/24; H04R 1/26; H04R 1/2803; H04R 1/2842; H04R 1/406; H04R 2410/07; H04R 3/04; H04R 3/12; H04R 5/00; H04R 9/063; G10K 11/1784; G10K 2210/1081; G10K 2210/3028; G10K 11/1786; G10K 2210/108; G10K 11/175; G10K 2210/12821; G10K 2210/3039
USPC ..... 381/13, 317, 71.1, 71.14, 71.11, 71.8, 381/370, 56, 74, 1, 182, 309, 367, 57, 381/94.1, 98, 99, 71.2, 71.6; 379/406.01, 379/406.05, 406.08
See application file for complete search history.

(56) References Cited

U.S. PATENT DOCUMENTS 4,649,507 A 3/1987 Inaba et al.
4,926,464 A 5/1990 Schley-May
4,998,241 A 3/1991 Brox et al.
5,018,202 A 5/1991 Takahashi
5,021,753 A 6/1991 Chapman
5,044,373 A 9/1991 Northeved et al.
5,117,401 A 5/1992 Feintuch
5,204,827 A 4/1993 Fujita et al.
5,251,263 A 10/1993 Andrea et al.
5,278,913 A 1/1994 Delfosse et al.
5,321,759 A 6/1994 Yuan
5,337,365 A 8/1994 Hamabe et al.
5,359,662 A 10/1994 Yuan et al.
5,377,276 A 12/1994 Terai et al.
5,386,477 A 1/1995 Popovich et al.
5,410,605 A 4/1995 Sawada et al.
5,425,105 A * 6/1995 Lo ..... G10K 11/1784 381/71.14
5,445,517 A 8/1995 Kondou et al.
5,465,413 A 11/1995 Enge et al.
5,481,615 A 1/1996 Eatwell et al.
5,548,681 A 8/1996 Gleaves et al.
5,550,925 A 8/1996 Hori et al.
5,559,893 A 9/1996 Krokstad et al.
5,563,819 A 10/1996 Nelson
5,586,190 A 12/1996 Trantow et al.
5,633,795 A 5/1997 Popovich
5,640,450 A 6/1997 Watanabe
5,668,747 A 9/1997 Ohashi
5,687,075 A 11/1997 Stothers
5,696,831 A 12/1997 Inanaga et al.
5,699,437 A 12/1997 Finn
5,706,344 A 1/1998 Finn
5,740,256 A 4/1998 Castello Da Costa et al.
5,768,124 A 6/1998 Stothers et al.
5,809,152 A 9/1998 Nakamura et al.
5,815,582 A 9/1998 Claybaugh et al.
5,832,095 A 11/1998 Daniels
5,852,667 A 12/1998 Pan et al.
5,909,498 A 6/1999 Smith
5,940,519 A 8/1999 Kuo
5,946,391 A 8/1999 Dragwidge et al.
5,991,418 A 11/1999 Kuo
6,041,126 A 3/2000 Terai et al.
6,118,878 A 9/2000 Jones
6,181,801 B1 1/2001 Puthuff et al.
6,185,300 B1 2/2001 Romesburg
6,219,427 B1 4/2001 Kates et al.
6,278,786 B1 8/2001 McIntosh
6,282,176 B1 8/2001 Hemkumar
6,304,179 B1 10/2001 Lolito et al.
6,317,501 B1 11/2001 Matsuo
6,418,228 B1 7/2002 Terai et al.
6,434,246 B1 8/2002 Kates et al.
6,434,247 B1 8/2002 Kates et al.
6,445,799 B1 9/2002 Taenzer et al.
6,522,746 B1 2/2003 Marchok et al.
6,542,436 B1 4/2003 Myllyla
6,606,382 B2 8/2003 Gupta
6,650,701 B1 11/2003 Hsiang et al.
6,683,960 B1 1/2004 Fujii et al.
6,738,482 B1 5/2004 Jaber
6,766,292 B1 7/2004 Chandran
6,768,795 B2 7/2004 Feltstrom et al.
6,792,107 B2 9/2004 Tucker et al.
6,847,721 B2 1/2005 Zhang et al.
6,850,617 B1 2/2005 Weigand
6,917,688 B2 7/2005 Yu et al.
6,940,982 B1 9/2005 Watkins
6,996,241 B2 2/2006 Ray et al.
7,003,093 B2 2/2006 Prabhu et al.
7,016,504 B1 3/2006 Shennib
7,034,614 B2 4/2006 Robinson et al.
7,058,463 B1 6/2006 Ruha et al.
7,092,514 B2 8/2006 Trump et al.
7,103,188 B1 9/2006 Jones
7,110,864 B2 9/2006 Restrepo et al.
7,142,894 B2 11/2006 Ichikawa et al.
7,162,044 B2 1/2007 Woods
7,177,433 B2 2/2007 Sibbald
7,181,030 B2 2/2007 Rasmussen et al.
7,242,778 B2 7/2007 Csermak et al.
7,321,913 B2 1/2008 McGrath
7,330,739 B2 2/2008 Somayajula
7,340,064 B2 3/2008 Onishi et al.
7,359,520 B2 4/2008 Brennan et al.
7,365,669 B1 4/2008 Melanson
7,368,918 B2 5/2008 Henson et al.
7,406,179 B2 7/2008 Ryan
7,441,173 B2 10/2008 Restrepo et al.
7,466,838 B1 12/2008 Mosely
7,492,889 B2 2/2009 Ebenezer
7,555,081 B2 6/2009 Keele, Jr.
7,643,641 B2 1/2010 Haulick et al.
7,680,456 B2 3/2010 Muhammad et al.
7,742,746 B2 6/2010 Xiang et al.
7,742,790 B2 6/2010 Konchitsky et al.
7,792,312 B2 9/2010 Inoue et al.
7,817,808 B2 10/2010 Konchitsky et al.
7,885,417 B2 2/2011 Christoph
7,885,420 B2 2/2011 Hetherington et al.
7,895,036 B2 2/2011 Hetherington et al.
7,925,307 B2 4/2011 Horowitz et al.

(56) References Cited

U.S. PATENT DOCUMENTS 7,953,231 B2 5/2011 Ishida
8,014,519 B2 9/2011 Mohammed et al.
8,019,050 B2 9/2011 Mactavish et al.
8,019,103 B2 9/2011 Kates
8,085,966 B2 12/2011 Amsel
8,098,837 B2 1/2012 Inoue et al.
8,107,637 B2 1/2012 Asada et al.
8,111,835 B2 2/2012 Inoue et al.
8,116,472 B2 2/2012 Mizuno
8,126,161 B2 2/2012 Togami et al.
8,135,140 B2 3/2012 Shridhar et al.
8,144,888 B2 3/2012 Berkhoff et al.
8,155,330 B2 4/2012 Chen
8,155,334 B2 4/2012 Joho et al.
8,165,312 B2 4/2012 Clemow
8,165,313 B2 4/2012 Carreras
8,184,816 B2 5/2012 Ramakrishnan et al.
8,184,822 B2 5/2012 Carreras et al.
8,189,799 B2 5/2012 Shridhar et al.
8,194,880 B2 6/2012 Avendano
8,194,881 B2 6/2012 Haulick et al.
8,194,882 B2 6/2012 Every et al.
8,199,923 B2 6/2012 Christoph
8,218,779 B2 7/2012 Isberg
8,218,782 B2 7/2012 Asada et al.
8,229,106 B2 7/2012 Greiss et al.
8,229,127 B2 7/2012 Jorgensen et al.
8,249,262 B2 8/2012 Chua et al.
8,249,535 B2 8/2012 Ridgers et al.
8,254,589 B2 8/2012 Mitsuhata
8,270,625 B2 9/2012 Sommerfeldt et al.
8,280,065 B2 10/2012 Nadjar et al.
8,285,344 B2 10/2012 Kahn et al.
8,290,177 B2 10/2012 Jeong et al.
8,290,537 B2 10/2012 Lee et al.
8,306,240 B2 11/2012 Pan et al.
8,311,243 B2 11/2012 Tucker et al.
8,315,405 B2 11/2012 Bakalos et al.
8,320,591 B1 * 11/2012 Wurtz ..... H04R 1/1083 379/110.01
8,325,934 B2 12/2012 Kuo
8,331,604 B2 12/2012 Saito et al.
8,345,888 B2 1/2013 Carreras et al.
8,345,890 B2 1/2013 Avendano et al.
8,355,512 B2 1/2013 Pan et al.
8,374,358 B2 2/2013 Buck et al.
8,374,362 B2 2/2013 Ramakrishnan et al.
8,379,884 B2 2/2013 Horibe et al.
8,385,559 B2 2/2013 Theverapperuma et al.
8,385,560 B2 2/2013 Solbeck et al.
8,401,200 B2 3/2013 Tiscareno et al.
8,401,204 B2 3/2013 Odent et al.
8,428,274 B2 4/2013 Shiraishi et al.
8,442,251 B2 5/2013 Jensen et al.
8,472,682 B2 6/2013 Guissin et al.
8,498,589 B2 7/2013 Husted et al.
8,515,089 B2 8/2013 Nicholson
8,526,627 B2 9/2013 Asao et al.
8,526,628 B1 9/2013 Massie et al.
8,532,310 B2 9/2013 Gauger, Jr. et al.
8,539,012 B2 9/2013 Clark
8,548,176 B2 10/2013 Bright
8,554,556 B2 10/2013 Yu
8,559,648 B2 10/2013 Christoph
8,559,661 B2 10/2013 Tanghe
8,600,085 B2 12/2013 Chen et al.
8,644,521 B2 2/2014 Christoph et al.
8,681,999 B2 3/2014 Theverapperuma et al.
8,682,250 B2 3/2014 Magrath et al.
8,693,699 B2 4/2014 Fellers et al.
8,693,700 B2 4/2014 Bakalos et al.
8,693,701 B2 4/2014 Scarlett et al.
8,706,482 B2 4/2014 Konchitsky
8,718,291 B2 5/2014 Alves et al.
8,737,633 B2 5/2014 Sibbald et al.
8,737,636 B2 5/2014 Park et al.
8,744,100 B2 6/2014 Kojima
8,744,844 B2 6/2014 Klein
8,750,531 B2 6/2014 Delano et al.
8,774,952 B2 7/2014 Kim et al.
8,775,172 B2 7/2014 Konchitsky et al.
8,804,974 B1 8/2014 Melanson
8,842,848 B2 9/2014 Donaldson et al.
8,848,936 B2 9/2014 Kwatra et al.
8,855,330 B2 10/2014 Taenzer
8,903,101 B2 12/2014 Christoph et al.
8,907,829 B1 12/2014 Naderi
8,908,877 B2 12/2014 Abdollahzadeh Milani et al.
8,909,524 B2 12/2014 Stoltz et al.
8,942,387 B2 1/2015 Elko et al.
8,942,976 B2 1/2015 Li et al.
8,948,407 B2 2/2015 Alderson et al.
8,948,410 B2 2/2015 Van Leest
8,953,813 B2 2/2015 Loeda
8,958,571 B2 2/2015 Kwatra et al.
8,977,545 B2 3/2015 Zeng et al.
9,014,387 B2 4/2015 Hendrix et al.
9,020,065 B2 4/2015 Wyville
9,020,158 B2 4/2015 Wertz et al.
9,020,160 B2 4/2015 Gauger, Jr.
9,031,251 B2 5/2015 Alcock
9,037,458 B2 5/2015 Park et al.
9,053,697 B2 6/2015 Park et al.
9,055,367 B2 6/2015 Li et al.
9,058,801 B2 6/2015 Po et al.
9,066,176 B2 6/2015 Hendrix et al.
9,071,724 B2 6/2015 Do et al.
9,076,427 B2 7/2015 Alderson et al.
9,076,431 B2 7/2015 Kamath et al.
9,082,387 B2 7/2015 Hendrix et al.
9,082,391 B2 7/2015 Yermeche et al.
9,094,744 B1 7/2015 Lu et al.
9,106,989 B2 8/2015 Li et al.
9,107,010 B2 8/2015 Abdollahzadeh Milani et al.
9,113,243 B2 8/2015 Nielsen et al.
9,123,321 B2 9/2015 Alderson et al.
9,123,325 B2 9/2015 Iseki et al.
9,129,586 B2 9/2015 Bajic et al.
9,131,294 B2 9/2015 Bright
9,135,907 B2 9/2015 Fellers et al.
9,142,205 B2 9/2015 Alderson et al.
9,142,207 B2 9/2015 Hendrix et al.
9,142,221 B2 9/2015 Sun et al.
9,153,226 B2 10/2015 Wurm
9,202,455 B2 12/2015 Park et al.
9,202,456 B2 12/2015 Lee et al.
9,203,366 B2 12/2015 Eastty
9,204,232 B2 12/2015 Klemmensen
9,208,769 B2 12/2015 Azmi
9,208,771 B2 12/2015 Zhou et al.
9,226,066 B2 12/2015 Ohta et al.
9,226,068 B2 12/2015 Hendrix et al.
9,230,532 B1 1/2016 Lu et al.
9,253,560 B2 2/2016 Goldstein et al.
9,264,808 B2 2/2016 Zhou et al.
9,291,697 B2 3/2016 Kim et al.
9,294,836 B2 3/2016 Zhou et al.
9,478,212 B1 10/2016 Sorensen et al.
2001/0053228 A1 12/2001 Jones
2004/0017921 A1 1/2004 Mantovani
2005/0018862 A1 1/2005 Fisher
2005/0117754 A1 6/2005 Sakawaki
2006/0013408 A1 1/2006 Lee
2006/0018460 A1 1/2006 McCree
2006/0035593 A1 2/2006 Leeds
2006/0055910 A1 3/2006 Lee
2006/0133636 A1 * 6/2006 Harvey ..... H04R 1/1016 381/380
2006/0153400 A1 7/2006 Fujita et al.
2006/0159282 A1 7/2006 Borsch
2006/0161428 A1 7/2006 Fouret
2006/0251266 A1 11/2006 Saunders et al.
2007/0033029 A1 2/2007 Sakawaki
2007/0047742 A1 3/2007 Taenzer et al.

(56) References Cited

U.S. PATENT DOCUMENTS

| | | | |
|---|---|---|---|
| 2007/0076896 | A1 | 4/2007 | Hosaka et al. |
| 2007/0208520 | A1 | 9/2007 | Zhang et al. |
| 2007/0258597 | A1 | 11/2007 | Rasmussen et al. |
| 2007/0297620 | A1 | 12/2007 | Choy |
| 2009/0034748 | A1 | 2/2009 | Sibbald |
| 2009/0175461 | A1 | 7/2009 | Nakamura et al. |
| 2010/0014683 | A1 | 1/2010 | Maeda et al. |
| 2010/0014685 | A1 | 1/2010 | Wurm |
| 2010/0061564 | A1 | 3/2010 | Clemow et al. |
| 2010/0082339 | A1 | 4/2010 | Konchitsky et al. |
| 2010/0124335 | A1 | 5/2010 | Wessling et al. |
| 2010/0166203 | A1 | 7/2010 | Peissig et al. |
| 2010/0166206 | A1 | 7/2010 | Macours |
| 2010/0226210 | A1 | 9/2010 | Kordis et al. |
| 2010/0284546 | A1 | 11/2010 | DeBrunner et al. |
| 2010/0296666 | A1 | 11/2010 | Lin |
| 2010/0310086 | A1 | 12/2010 | Magrath et al. |
| 2011/0026724 | A1 | 2/2011 | Doclo |
| 2011/0091047 | A1 | 4/2011 | Konchitsky et al. |
| 2011/0099010 | A1 | 4/2011 | Zhang |
| 2011/0116654 | A1 | 5/2011 | Chan et al. |
| 2011/0288860 | A1 | 11/2011 | Schevciw et al. |
| 2011/0317848 | A1 | 12/2011 | Ivanov et al. |
| 2012/0135787 | A1 | 5/2012 | Kusunoki et al. |
| 2012/0140917 | A1 | 6/2012 | Nicholson et al. |
| 2012/0155666 | A1 | 6/2012 | Nair |
| 2012/0179458 | A1 | 7/2012 | Oh et al. |
| 2012/0259626 | A1* | 10/2012 | Li ..... H04R 1/1083 704/226 |
| 2012/0263317 | A1 | 10/2012 | Shin et al. |
| 2012/0281850 | A1 | 11/2012 | Hyatt |
| 2012/0300960 | A1 | 11/2012 | Mackay et al. |
| 2012/0308025 | A1 | 12/2012 | Hendrix et al. |
| 2012/0308027 | A1 | 12/2012 | Kwatra |
| 2012/0308028 | A1 | 12/2012 | Kwatra et al. |
| 2013/0010982 | A1 | 1/2013 | Elko et al. |
| 2013/0156238 | A1 | 6/2013 | Birch et al. |
| 2013/0243198 | A1 | 9/2013 | Van Rumpt |
| 2013/0243225 | A1 | 9/2013 | Yokota |
| 2013/0301846 | A1 | 11/2013 | Alderson et al. |
| 2013/0301848 | A1 | 11/2013 | Zhou et al. |
| 2013/0315403 | A1 | 11/2013 | Samuelsson |
| 2013/0343571 | A1 | 12/2013 | Rayala et al. |
| 2014/0016803 | A1 | 1/2014 | Puskarich |
| 2014/0036127 | A1 | 2/2014 | Pong et al. |
| 2014/0044275 | A1 | 2/2014 | Goldstein et al. |
| 2014/0086425 | A1 | 3/2014 | Jensen et al. |
| 2014/0146976 | A1 | 5/2014 | Rundle |
| 2014/0177851 | A1 | 6/2014 | Kitazawa et al. |
| 2014/0177890 | A1 | 6/2014 | Hojlund et al. |
| 2014/0211953 | A1 | 7/2014 | Alderson et al. |
| 2014/0270222 | A1 | 9/2014 | Hendrix et al. |
| 2014/0294182 | A1 | 10/2014 | Axelsson et al. |
| 2014/0307887 | A1 | 10/2014 | Alderson |
| 2014/0307888 | A1 | 10/2014 | Alderson et al. |
| 2014/0314244 | A1 | 10/2014 | Yong |
| 2014/0314246 | A1 | 10/2014 | Hellman |
| 2014/0314247 | A1 | 10/2014 | Zhang |
| 2014/0341388 | A1 | 11/2014 | Goldstein et al. |
| 2015/0092953 | A1 | 4/2015 | Abdollahzadeh Milani et al. |
| 2015/0104032 | A1 | 4/2015 | Kwatra et al. |
| 2015/0161980 | A1 | 6/2015 | Alderson et al. |
| 2015/0161981 | A1 | 6/2015 | Kwatra |
| 2015/0163592 | A1 | 6/2015 | Alderson |
| 2015/0195646 | A1 | 7/2015 | Kumar et al. |
| 2015/0256660 | A1 | 9/2015 | Kaller et al. |
| 2015/0256953 | A1 | 9/2015 | Kwatra et al. |
| 2015/0269926 | A1 | 9/2015 | Alderson et al. |
| 2015/0296296 | A1 | 10/2015 | Lu et al. |
| 2015/0365761 | A1 | 12/2015 | Alderson et al. |
| 2016/0063988 | A1 | 3/2016 | Hendrix et al. |

FOREIGN PATENT DOCUMENTS

| | | | |
|---|---|---|---|
| EP | 0412902 | A2 | 2/1991 |
| EP | 0756407 | A2 | 1/1997 |
| EP | 0898266 | A2 | 2/1999 |
| EP | 1691577 | A2 | 8/2006 |
| EP | 1880699 | A2 | 1/2008 |
| EP | 1921603 | A2 | 5/2008 |
| EP | 1947642 | A1 | 7/2008 |
| EP | 2133866 | A1 | 12/2009 |
| EP | 2216774 | A1 | 8/2010 |
| EP | 2237573 | A1 | 10/2010 |
| EP | 2259250 | A1 | 12/2010 |
| EP | 2395500 | A1 | 12/2011 |
| EP | 2395501 | A1 | 12/2011 |
| EP | 2551845 | A1 | 1/2013 |
| GB | 2401744 | A | 11/2004 |
| GB | 2436657 | A | 10/2007 |
| GB | 2455821 | A | 6/2009 |
| GB | 2455824 | A | 6/2009 |
| GB | 2455828 | A | 6/2009 |
| GB | 2484722 | A | 4/2012 |
| GB | 2539280 | A | 12/2016 |
| JP | 52071502 | | 5/1977 |
| JP | 03162099 | | 7/1991 |
| JP | H05265468 | | 10/1993 |
| JP | 05341792 | | 12/1993 |
| JP | 06006246 | | 1/1994 |
| JP | H06-186985 | A | 7/1994 |
| JP | H06232755 | | 8/1994 |
| JP | 07098592 | | 4/1995 |
| JP | 07104769 | | 4/1995 |
| JP | H017106886 | A | 4/1995 |
| JP | 07240989 | | 9/1995 |
| JP | 07325588 | | 12/1995 |
| JP | H07334169 | | 12/1995 |
| JP | H08227322 | | 9/1996 |
| JP | H10247088 | | 9/1998 |
| JP | H10257159 | | 9/1998 |
| JP | 10294989 | | 11/1998 |
| JP | H11305783 | A | 11/1999 |
| JP | 2000089770 | | 3/2000 |
| JP | 2002010355 | | 1/2002 |
| JP | 2004007107 | | 1/2004 |
| JP | 2006217542 | A | 8/2006 |
| JP | 2007003994 | | 1/2007 |
| JP | 2007060644 | | 3/2007 |
| JP | 2007175486 | | 7/2007 |
| JP | 2008015046 | A | 1/2008 |
| JP | 2010277025 | | 12/2010 |
| JP | 2011055494 | | 3/2011 |
| JP | 2011061449 | | 3/2011 |
| WO | WO 199113429 | | 9/1991 |
| WO | WO 1993004529 | | 3/1993 |
| WO | WO 1994007212 | | 3/1994 |
| WO | WO 1999011045 | | 3/1999 |
| WO | WO 2003015074 | A1 | 2/2003 |
| WO | WO 2003015275 | A1 | 2/2003 |
| WO | WO 2004009007 | A1 | 1/2004 |
| WO | WO 2004017303 | A1 | 2/2004 |
| WO | WO 2006125061 | A1 | 11/2006 |
| WO | WO 2006128768 | A1 | 12/2006 |
| WO | WO 2007007916 | A1 | 1/2007 |
| WO | WO 2007011337 | | 1/2007 |
| WO | WO 2007110807 | A2 | 10/2007 |
| WO | WO 2007113487 | A1 | 11/2007 |
| WO | WO 2009041012 | A1 | 4/2009 |
| WO | WO 2009110087 | A1 | 9/2009 |
| WO | WO 2009155696 | A1 | 12/2009 |
| WO | WO 2010117714 | A1 | 10/2010 |
| WO | WO 2010131154 | A1 | 11/2010 |
| WO | WO 2012134874 | A1 | 10/2012 |
| WO | WO-2013106370 | A1 | 7/2013 |
| WO | WO 2015038255 | A1 | 3/2015 |
| WO | WO 2015088639 | A1 | 6/2015 |
| WO | WO 2015088651 | A1 | 6/2015 |
| WO | WO 2016054186 | A1 | 4/2016 |
| WO | WO-2016100602 | A1 | 6/2016 |

(56) References Cited

FOREIGN PATENT DOCUMENTS

OTHER PUBLICATIONS

Lopez-Caudana, et al., "A Hybrid Noise Cancelling Algorithm with Secondary Path Estimation", WSEAS Transactions on Signal Processing, vol. 4, No. 12, Dec. 2008, pp. 677-687, Mexico.
Goeckler, H.G. et al., "Efficient Multirate Digital Filters Based on Fractional Polyphase Decomposition for Subnyquist Processing", Proceedings of the European Conference on Circuit Theory & Design, vol. 1, Jan. 1, 1999, pp. 409-412.
U.S. Appl. No. 13/686,353, filed Nov. 27, 2012, Hendrix, et al.
U.S. Appl. No. 13/794,979, filed Mar. 12, 2013, Alderson, et al.
U.S. Appl. No. 14/210,537, filed Mar. 14, 2014, Abdollahzadeh Milani, et.
U.S. Appl. No. 14/210,589, filed Mar. 14, 2014, Abdollahzadeh Milani, et.
U.S. Appl. No. 13/721,832, filed Dec. 20, 2012, Lu, et al.
U.S. Appl. No. 13/968,013, filed Aug. 15, 2013, Abdollahzadeh Milani et.
U.S. Appl. No. 15/070,564, filed Mar. 15, 2016, Zhou, et al.
U.S. Appl. No. 15/130,271, filed Apr. 15, 2016, Hendrix, et al.
Pfann, et al., "LMS Adaptive Filtering with Delta-Sigma Modulated Input Signals," IEEE Signal Processing Letters, Apr. 1998, pp. 95-97, vol. 5, No. 4, IEEE Press, Piscataway, NJ.
Toochinda, et al. "A Single-Input Two-Output Feedback Formulation for ANC Problems," Proceedings of the 2001 American Control Conference, Jun. 2001, pp. 923-928, vol. 2, Arlington, VA.
Kuo, et al., "Active Noise Control: A Tutorial Review," Proceedings of the IEEE, Jun. 1999, pp. 943-973, vol. 87, No. 6, IEEE Press, Piscataway, NJ.
Johns, et al., "Continuous-Time LMS Adaptive Recursive Filters," IEEE Transactions on Circuits and Systems, Jul. 1991, pp. 769-778, vol. 38, No. 7, IEEE Press, Piscataway, NJ.
Shoval, et al., "Comparison of DC Offset Effects in Four LMS Adaptive Algorithms," IEEE Transactions on Circuits and Systems II: Analog and Digital Processing, Mar. 1995, pp. 176-185, vol. 42, Issue 3, IEEE Press, Piscataway, NJ.
Mali, Dilip, "Comparison of DC Offset Effects on LMS Algorithm and its Derivatives," International Journal of Recent Trends in Engineering, May 2009, pp. 323-328, vol. 1, No. 1, Academy Publisher.
Kates, James M., "Principles of Digital Dynamic Range Compression," Trends in Amplification, Spring 2005, pp. 45-76, vol. 9, No. 2, Sage Publications.
Gao, et al., "Adaptive Linearization of a Loudspeaker," IEEE International Conference on Acoustics, Speech, and Signal Processing, Apr. 14-17, 1991, pp. 3589-3592, Toronto, Ontario, CA.
Silva, et al., "Convex Combination of Adaptive Filters With Different Tracking Capabilities," IEEE International Conference on Acoustics, Speech, and Signal Processing, Apr. 15-20, 2007, pp. III 925-928, vol. 3, Honolulu, HI, USA.
Akhtar, et al., "A Method for Online Secondary Path Modeling in Active Noise Control Systems," IEEE International Symposium on Circuits and Systems, May 23-26, 2005, pp. 264-267, vol. 1, Kobe, Japan.
Davari, et al., "A New Online Secondary Path Modeling Method for Feedforward Active Noise Control Systems," IEEE International Conference on Industrial Technology, Apr. 21-24, 2008, pp. 1-6, Chengdu, China.
Lan, et al., "An Active Noise Control System Using Online Secondary Path Modeling With Reduced Auxiliary Noise," IEEE Signal Processing Letters, Jan. 2002, pp. 16-18, vol. 9, Issue 1, IEEE Press, Piscataway, NJ.
Liu, et al., "Analysis of Online Secondary Path Modeling With Auxiliary Noise Scaled by Residual Noise Signal," IEEE Transactions on Audio, Speech and Language Processing, Nov. 2010, pp. 1978-1993, vol. 18, Issue 8, IEEE Press, Piscataway, NJ.
Black, John W., "An Application of Side-Tone in Subjective Tests of Microphones and Headsets", Project Report No. NM 001 064.01.20, Research Report of the U.S. Naval School of Aviation Medicine, Feb. 1, 1954, 12 pages (pp. 1-12 in pdf), Pensacola, FL, US.
Peters, Robert W., "The Effect of High-Pass and Low-Pass Filtering of Side-Tone Upon Speaker Intelligibility", Project Report No. NM 001 064.01.25, Research Report of the U.S. Naval School of Aviation Medicine, Aug. 16, 1954, 13 pages (pp. 1-13 in pdf), Pensacola, FL, US.
Lane, et al., "Voice Level: Autophonic Scale, Perceived Loudness, and the Effects of Sidetone", The Journal of the Acoustical Society of America, Feb. 1961, pp. 160-167, vol. 33, No. 2., Cambridge, MA, US.
Liu, et al., "Compensatory Responses to Loudness-shifted Voice Feedback During Production of Mandarin Speech", Journal of the Acoustical Society of America, Oct. 2007, pp. 2405-2412, vol. 122, No. 4.
Paepcke, et al., "Yelling in the Hall: Using Sidetone to Address a Problem with Mobile Remote Presence Systems", Symposium on User Interface Software and Technology, Oct. 16-19, 2011, 10 pages (pp. 110 in pdf), Santa Barbara, CA, US.
Therrien, et al., "Sensory Attenuation of Self-Produced Feedback: The Lombard Effect Revisited", PLOS One, Nov. 2012, pp. 1-7, vol. 7, Issue 11, e49370, Ontario, Canada.
Abdollahzadeh Milani, et al., "On Maximum Achievable Noise Reduction in ANC Systems",2010 IEEE International Conference on Acoustics Speech and Signal Processing, Mar. 14-19, 2010, pp. 349-352, Dallas, TX, US.
Cohen, Israel, "Noise Spectrum Estimation in Adverse Environments: Improved Minima Controlled Recursive Averaging", IEEE Transactions on Speech and Audio Processing, Sep. 2003, pp. 1-11, vol. 11, Issue 5, Piscataway, NJ, US.
Ryan, et al., "Optimum Near-Field Performance of Microphone Arrays Subject to a Far-Field Beampattern Constraint", J. Acoust. Soc. Am., Nov. 2000, pp. 2248-2255, 108 (5), Pt. 1, Ottawa, Ontario, Canada.
Cohen, et al., "Noise Estimation by Minima Controlled Recursive Averaging for Robust Speech Enhancement", IEEE Signal Processing Letters, Jan. 2002, pp. 12-15, vol. 9, No. 1, Piscataway, NJ, US.
Martin, Rainer, "Noise Power Spectral Density Estimation Based on Optimal Smoothing and Minimum Statistics", IEEE Transactions on Speech and Audio Processing, Jul. 2001, pp. 504-512, vol. 9, No. 5, Piscataway, NJ, US.
Martin, Rainer, "Spectral Subtraction Based on Minimum Statistics", Signal Processing VII Theories and Applications, Proceedings of EUSIPCO-94, 7th European Signal Processing Conference, Sep. 13-16, 1994, pp. 1182-1185, vol. III, Edinburgh, Scotland, U.K.
Booij, et al., "Virtual sensors for local, three dimensional, broadband multiple-channel active noise control and the effects on the quiet zones", Proceedings of the International Conference on Noise and Vibration Engineering, ISMA 2010, Sep. 20-22, 2010, pp. 151-166, Leuven.
Kuo, et al., "Residual noise shaping technique for active noise control systems", J. Acoust. Soc. Am. 95 (3), Mar. 1994, pp. 1665-1668.
Lopez-Gaudana, Edgar Omar, "Active Noise Cancellation: The Unwanted Signal and The Hybrid Solution", Adaptive Filtering Applications, Dr. Lino Garcia (Ed.), Jul. 2011, pp. 49-84, ISBN: 978-953-307306-4, InTech.
Senderowicz, et al., "Low-Voltage Double-Sampled Delta-Sigma Converters", IEEE Journal on Solid- State Circuits, Dec. 1997, pp. 1907-1919, vol. 32, No. 12, Piscataway, NJ.
Hurst, et al., "An improved double sampling scheme for switched-capacitor delta-sigma modulators", 1992 IEEE Int. Symp. On Circuits and Systems, May 10-13, 1992, vol. 3, pp. 1179-1182, San Diego, CA.
Campbell, Mikey, "Apple looking into self-adjusting earbud headphones with noise cancellation tech", Apple Insider, Jul. 4, 2013, pp. 1-10 (10 pages in pdf), downloaded on May 14, 2014 from http://appleinsider.com/articles/13/07/04/apple-looking-into-self-adjusting-earbud-headphones-with-noise-cancellation-tech.

(56) References Cited

OTHER PUBLICATIONS

Jin, et al. "A simultaneous equation method-based online secondary path modeling algorithm for active noise control", Journal of Sound and Vibration, Apr. 25, 2007, pp. 455-474, vol. 303, No. 3-5, London, GB.
Erkelens, et al., "Tracking of Nonstationary Noise Based on Data-Driven Recursive Noise Power Estimation", IEEE Transactions on Audio Speech and Language Processing, Aug. 2008, pp. 1112-1123, vol. 16, No. 6, Piscataway, NJ, US.
Rao, et al., "A Novel Two State Single Channel Speech Enhancement Technique", India Conference (INDICON) 2011 Annual IEEE, IEEE, Dec. 2011, 6 pages (pp. 1-6 in pdf), Piscataway, NJ, US.
Rangachari, et al., "A noise-estimation algorithm for highly non-stationary environments", Speech Communication, Feb. 2006, pp. 220-231, vol. 48, No. 2. Elsevier Science Publishers.
Parkins, et al., "Narrowband and broadband active control in an enclosure using the acoustic energy density", J. Acoust. Soc. Am. Jul. 2000, pp. 192-203, vol. 108, issue 1, US.
Feng, Jinwei et al., "A broadband self-tuning active noise equaliser", Signal Processing, Elsevier Science Publishers B.V. Amsterdam, NL, vol. 62, No. 2, Oct. 1, 1997, pp. 251-256.
Zhang, Ming et al., "A Robust Online Secondary Path Modeling Method with Auxiliary Noise Power Scheduling Strategy and Norm Constraint Manipulation", IEEE Transactions on Speech and Audio Processing, IEEE Service Center, New York, NY, vol. 11, No. 1, Jan. 1, 2003.
Lopez-Gaudana, Edgar et al., "A hybrid active noise cancelling with secondary path modeling", 51st Midwest Symposium on Circuits and Systems, 2008, MWSCAS 2008, Aug. 10, 2008, pp. 277-280.
Widrow, B., et al., Adaptive Noise Cancelling; Principles and Applications, Proceedings of the IEEE, Dec. 1975, pp. 1692-1716, vol. 63, No. 13, IEEE, New York, NY, US.
Morgan, et al., A Delayless Subband Adaptive Filter Architecture, IEEE Transactions on Signal Processing, IEEE Service Center, Aug. 1995, pp. 1819-1829, vol. 43, No. 8, New York, NY, US.
Rafaely, Boaz, "Active Noise Reducing Headset—an Overview", The 2001 International Congress and Exhibition on Noise Control Engineering, Aug. 27-30, 2001, 10 pages (pp. 1-10 in pdf), The Netherlands.
Ray, et al., "Hybrid Feedforward-Feedback Active Noise Reduction for Hearing Protection and Communication", The Journal of the Acoustical Society of America, American Institute of Physics for the Acoustical Society of America, Jan. 2006, pp. 2026-2036, vol. 120, No. 4, New York, NY.
Office Action in U.S. Appl. No. 13/968,007 dated Apr. 16, 2015, 38 pages (pp. 1-38 in pdf).
Notice of Allowance in U.S. Appl. No. 13/968,007 dated Sep. 23, 2015, 14 pages (pp. 1-14 in pdf).
Notice of Allowance in U.S. Appl. No. 13/968,007 dated May 5, 2016, 7 pages (pp. 1-7 in pdf).
International Search Report and Written Opinion in PCT/US2014/016833 dated Jun. 2, 2014, 13 pages (pp. 1-13 in pdf).
Written Opinion of the International Preliminary Examining Authority in PCT/US2014/016833 dated Mar. 3, 2015, 4 pages (pp. 1-4 in pdf).
International Preliminary Report on Patentability in PCT/US2014/016833 dated Jun. 19, 2015, 31 pages (pp. 1-31 in pdf).
U.S. Appl. No. 14/832,585, filed Aug. 21, 2015, Zhou.
U.S. Appl. No. 15/241,375, filed Aug. 19, 2016, Lu, et al.

* cited by examiner

LOW-LATENCY MULTI-DRIVER ADAPTIVE NOISE CANCELING (ANC) SYSTEM FOR A PERSONAL AUDIO DEVICE

This U.S. patent application is a Continuation of U.S. patent application Ser. No. 13/968,007 filed on Aug. 15, 2013, published as U.S. Patent Publication No. 20140270222 on Sep. 18, 2014, and claims priority thereto under 35 U.S.C. § 120. U.S. patent application Ser. No. 13/968,007 claims priority under 35 U.S.C. § 119(e) to U.S. Provisional Patent Application Ser. No. 61/783,267 filed on Mar. 14, 2013 and this U.S. patent application claims priority to the above-referenced U.S. Provisional patent application thereby.

BACKGROUND OF THE INVENTION

1. Field of the Invention

The present invention relates generally to personal audio devices that include adaptive noise cancellation (ANC) and multiple drivers for differing frequency bands.

2. Background of the Invention

Wireless telephones, such as mobile/cellular telephones, cordless telephones, and other consumer audio devices, such as MP3 players, are in widespread use. Performance of such devices with respect to intelligibility can be improved by providing ANC using a reference microphone to measure ambient acoustic events and then using signal processing to insert an anti-noise signal into the output of the device to cancel the ambient acoustic events.

While most audio systems implemented for personal audio devices rely on a single output transducer, in the case of transducers mounted on the housing of a wireless telephone, or a pair of transducers when earspeakers are used or when a wireless telephone or other device employs stereo speakers, for high quality audio reproduction, it may be desirable to provide separate transducers for high and low frequencies, as in high quality earspeakers. However, when implementing ANC in such systems, the latency introduced by the crossover that splits the signals between the low frequency transducer and the high frequency transducer introduces delay, which reduces the effectiveness of the ANC system, due to the increased latency of operation.

Therefore, it would be desirable to provide a personal audio device, including a wireless telephone and/or earspeakers that provide low-latency ANC operation while using multiple output transducers that handle different frequency bands.

SUMMARY OF THE INVENTION

The above-stated objectives of providing a personal audio device having ANC and employing multiple output transducers for handling different frequency bands, is accomplished in a personal audio system, a method of operation, and an integrated circuit.

The personal audio device includes both a low-frequency output transducer and a high-frequency transducer for reproducing a source audio signal for playback to a listener, and anti-noise signals for countering the effects of ambient audio sounds in the acoustic outputs of transducers. The personal audio device also includes the integrated circuit to provide adaptive noise-canceling (ANC) functionality. The method is a method of operation of the personal audio system and integrated circuit. A reference microphone is mounted on the device housing to provide a reference microphone signal indicative of the ambient audio sounds. The personal audio system further includes an ANC processing circuit for adaptively generating the anti-noise signals from the reference microphone signal, such that the anti-noise signals cause substantial cancellation of the ambient audio sounds at their corresponding transducers. Adaptive filters are used to generate the anti-noise signals by filtering the reference microphone signal.

The foregoing and other objectives, features, and advantages of the invention will be apparent from the following, more particular, description of the preferred embodiment of the invention, as illustrated in the accompanying drawings.

DESCRIPTION OF ILLUSTRATIVE EMBODIMENT

The present invention encompasses noise canceling techniques and circuits that can be implemented in a personal audio system, such as a wireless telephone and connected earbuds. The personal audio system includes an adaptive noise canceling (ANC) circuit that measures and attempts to cancel the ambient acoustic environment at the earbuds or other output transducer location such as on the housing of a personal audio device that receives or generates the source audio signal. Multiple transducers are used, including a low-frequency and a high-frequency transducer that reproduce corresponding frequency bands of the source audio to provide a high quality audio output. The ANC circuit generates separate anti-noise signals which are provided to respective ones of the multiple transducers, to cancel ambient acoustic events at the transducers. A reference microphone is provided to measure the ambient acoustic environment, which provides an input to separate adaptive filters that generate the anti-noise signals, so that low-latency is maintained by eliminating a need for crossover filtering of the generated anti-noise. The source audio crossover can then be placed ahead of the summation of source audio frequency band-specific components with their corresponding anti-noise signals, and the adaptive filters can be controlled to generate anti-noise only in the frequency ranges appropriate for their corresponding transducers.

Figure 1A:
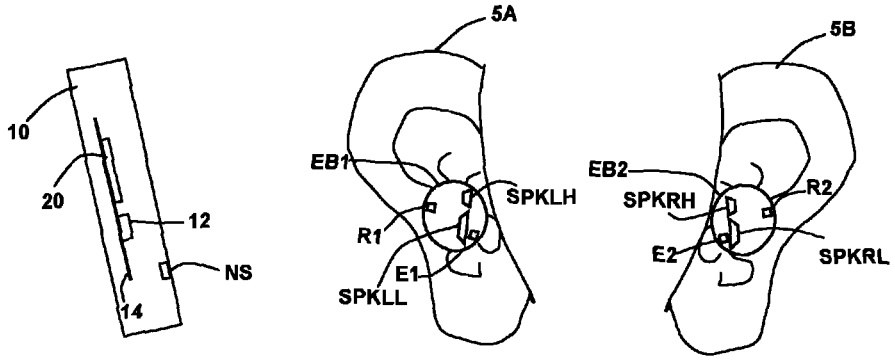
FIG. 1A is an illustration of an exemplary wireless telephone 10 and a pair of earbuds EB1 and EB2.

FIG. 1A shows a wireless telephone 10 and a pair of earbuds EB1 and EB2, each attached to a corresponding ear 5A, 5B of a listener. Illustrated wireless telephone 10 is an example of a device in which the techniques disclosed herein may be employed, but it is understood that not all of the elements or configurations illustrated in wireless telephone 10, or in the circuits depicted in subsequent illustrations, are required. Wireless telephone 10 is connected to earbuds EB1, EB2 by a wired or wireless connection, e.g., a BLUETOOTH™ connection (BLUETOOTH is a trademark of Bluetooth SIG, Inc.). Earbuds EB1, EB2 each have a corresponding pair of transducers SPKLH/SPKLL and SPKRH/SPKRL, respectively, which reproduce source audio including distant speech received from wireless telephone 10, ringtones, stored audio program material, and injection of near-end speech (i.e., the speech of the user of wireless telephone 10). Transducers SPKLH and SPKRH are high-frequency transducers or "tweeters" that reproduce the higher range of audible frequencies and transducers SPKLL and SPKRL are low-frequency transducers or "woofers" that reproduce a lower range of audio frequencies. The source audio also includes any other audio that wireless telephone 10 is required to reproduce, such as source audio from web-pages or other network communications received by wireless telephone 10 and audio indications such as battery low and other system event notifications. Reference microphones R1, R2 are provided on a surface of a housing of respective earbuds EB1, EB2 for measuring the ambient acoustic environment. Another pair of microphones, error microphones E1, E2, are provided in order to further improve the ANC operation by providing a measure of the ambient audio combined with the audio reproduced by respective transducer pairs SPKLH/SPKLL and SPKRH/SPKRL close to corresponding ears 5A, 5B, when earbuds EB1, EB2 are inserted in the outer portion of ears 5A, 5B.

Wireless telephone 10 includes adaptive noise canceling (ANC) circuits and features that inject anti-noise signals into transducers SPKLH, SPKLL, SPKRH and SPKRL to improve intelligibility of the distant speech and other audio reproduced by transducers SPKLH, SPKLL, SPKRH and SPKRL An exemplary circuit 14 within wireless telephone 10 includes an audio integrated circuit 20 that receives the signals from reference microphones R1, R2, a near speech microphone NS, and error microphones E1, E2 and interfaces with other integrated circuits such as an RF integrated circuit 12 containing the wireless telephone transceiver. In other implementations, the circuits and techniques disclosed herein may be incorporated in a single integrated circuit that contains control circuits and other functionality for implementing the entirety of the personal audio device, such as an MP3 player-on-a-chip integrated circuit. Alternatively, the ANC circuits may be included within the housing of earbuds EB1, EB2 or in a module located along wired connections between wireless telephone 10 and earbuds EB1, EB2. For the purposes of illustration, the ANC circuits will be described as provided within wireless telephone 10, but the above variations are understandable by a person of ordinary skill in the art and the consequent signals that are required between earbuds EB1, EB2, wireless telephone 10, and a third module, if required, can be easily determined for those variations. Near speech microphone NS is provided at a housing of wireless telephone 10 to capture near-end speech, which is transmitted from wireless telephone 10 to the other conversation participant(s). Alternatively, near speech microphone NS may be provided on the outer surface of the housing of one of earbuds EB1, EB2, on a boom affixed to one of earbuds EB1, EB2, or on a pendant located between wireless telephone 10 and either or both of earbuds EB1, EB2.

Figure 1B:
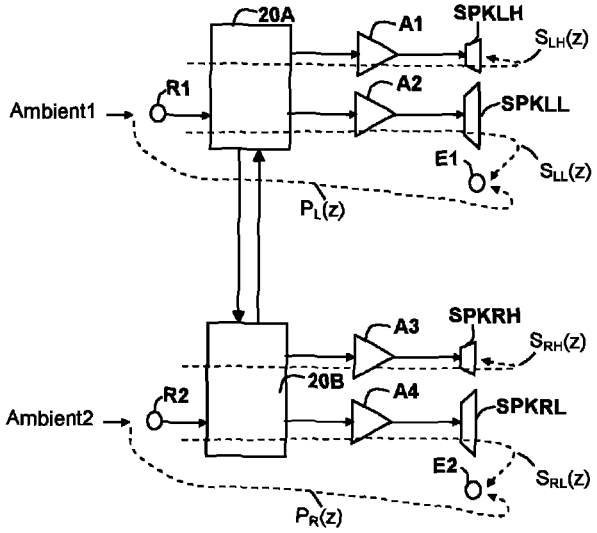
FIG. 1B is a schematic diagram of circuits within wireless telephone 10.

FIG. 1B shows a simplified schematic diagram of audio integrated circuits 20A, 20B that include ANC processing, as coupled to reference microphones R1, R2, which provide a measurement of ambient audio sounds Ambient1, Ambient 2 that is filtered by the ANC processing circuits within audio integrated circuits 20A, 20B, located within corresponding earbuds EB1, EB2. Audio integrated circuits 20A, 20B may be alternatively combined in a single integrated circuit such as integrated circuit 20 within wireless telephone 10. Audio integrated circuits 20A, 20B generate outputs for their corresponding channels that are amplified by an associated one of amplifiers A1-A4 and which are provided to the corresponding transducer pairs SPKLH/SPKLL and SPKRH/SPKRL. Audio integrated circuits 20A, 20B receive the signals (wired or wireless depending on the particular configuration) from reference microphones R1, R2, near speech microphone NS and error microphones E1, E2. Audio integrated circuits 20A, 20B also interface with other integrated circuits such as RF integrated circuit 12 containing the wireless telephone transceiver shown in FIG. 1A. In other configurations, the circuits and techniques disclosed herein may be incorporated in a single integrated circuit that contains control circuits and other functionality for implementing the entirety of the personal audio device, such as a MP3 player-on-a-chip integrated circuit. Alternatively, multiple integrated circuits may be used, for example, when a wireless connection is provided from each of earbuds EB1, EB2 to wireless telephone 10 and/or when some or all of the ANC processing is performed within earbuds EB1, EB2 or a module disposed along a cable connecting wireless telephone 10 to earbuds EB1, EB2.

In general, the ANC techniques illustrated herein measure ambient acoustic events (as opposed to the output of transducers SPKLH, SPKLL, SPKRH and SPKRL and/or the near-end speech) impinging on reference microphones R1, R2 and also measure the same ambient acoustic events impinging on error microphones E1, E2. The ANC processing circuits of integrated circuits 20A, 20B individually adapt an anti-noise signal generated from the output of the corresponding reference microphone R1, R2 to have a characteristic that minimizes the amplitude of the ambient acoustic events at the corresponding error microphone E1, E2. Since acoustic path $P_L(z)$ extends from reference microphone R1 to error microphone E1, the ANC circuit in audio integrated circuit 20A is essentially estimating acoustic path $P_L(z)$ combined with removing effects of electro-acoustic paths $S_{LH}(z)$ and $S_{LL}(z)$ that represent, respectively, the response of the audio output circuits of audio integrated circuit 20A and the acoustic/electric transfer function of transducers SPKLH and SPKLL. The estimated response includes the coupling between transducers SPKLH, SPKLL and error microphone E1 in the particular acoustic environment which is affected by the proximity and structure of ear 5A and other physical objects and human head structures that may be in proximity to earbud EB1. Similarly, audio integrated circuit 20B estimates acoustic path $P_R(z)$ combined with removing effects of electro-acoustic paths $S_{RH}(z)$ and $S_{RL}(z)$ that represent, respectively, the response of the audio output circuits of audio integrated circuit 20B and the acoustic/electric transfer function of transducers SPKRH and SPKRL.

Figure 2:
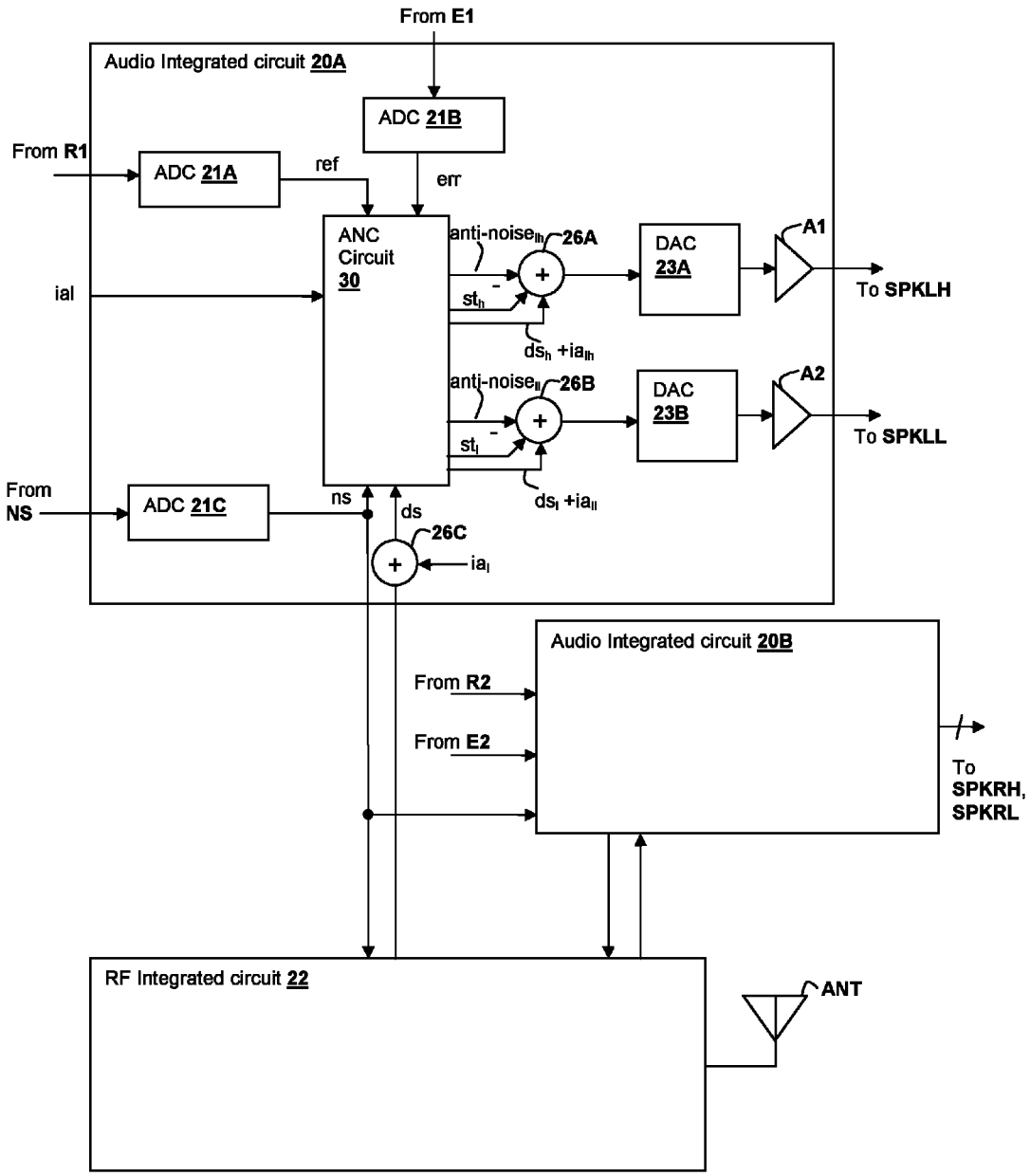
FIG. 2 is a block diagram of circuits within wireless telephone 10.

Referring now to FIG. 2, circuits within earbuds EB1, EB2 and wireless telephone 10 are shown in a block diagram. The circuit shown in FIG. 2 further applies to the other configurations mentioned above, except that signaling between CODEC integrated circuit 20 and other units within wireless telephone 10 are provided by cables or wireless connections when audio integrated circuits 20A, 20B are located outside of wireless telephone 10, e.g., within corresponding earbuds EB1, EB2. In such a configuration, signaling between a single integrated circuit 20 that implements integrated circuits 20A-20B and error microphones E1, E2, reference microphones R1, R2 and transducers SPKLH, SPKLL, SPKRH and SPKRL are provided by wired or wireless connections when audio integrated circuit 20 is located within wireless telephone 10. In the illustrated example, audio integrated circuits 20A, 20B are shown as separate and substantially identical circuits, so only audio integrated circuit 20A will be described in detail below.

Audio integrated circuit 20A includes an analog-to-digital converter (ADC) 21A for receiving the reference microphone signal from reference microphone R1 and generating a digital representation ref of the reference microphone signal. Audio integrated circuit 20A also includes an ADC 21B for receiving the error microphone signal from error microphone E1 and generating a digital representation err of the error microphone signal, and an ADC 21C for receiving the near speech microphone signal from near speech microphone NS and generating a digital representation of near speech microphone signal ns. (Audio integrated circuit 20B receives the digital representation of near speech microphone signal ns from audio integrated circuit 20A via the wireless or wired connections as described above.) Audio integrated circuit 20A generates an output for driving transducer SPKLH from an amplifier A1, which amplifies the output of a digital-to-analog converter (DAC) 23A that receives the output of a combiner 26A. A combiner 26C combines left-channel internal audio signal ial and source audio ds, which is received from a radio frequency (RF) integrated circuit 22. Combiner 26A combines source audio $ds_h+ia_{lh}$, which is the high-frequency band component of the output of combiner 26C with high-frequency band anti-noise signal $\text{anti-noise}_{lh}$ generated by a left-channel ANC circuit 30, which by convention has the same polarity as the noise in reference microphone signal ref and is therefore subtracted by combiner 26A. Combiner 26A also combines an attenuated high-frequency portion of near speech signal ns, i.e., sidetone information $st_h$, so that the user of wireless telephone 10 hears their own voice in proper relation to downlink speech ds. Near speech signal ns is also provided to RF integrated circuit 22 and is transmitted as uplink speech to the service provider via an antenna ANT. Similarly, left-channel audio integrated circuit 20A generates an output for driving transducer SPKLL from an amplifier A2, which amplifies the output of a digital-to-analog converter (DAC) 23B that receives the output of a combiner 26B. Combiner 26B combines source audio $ds_l+ia_{ll}$, which is the low-frequency band component of the output of combiner 26C with low-frequency band anti-noise signal $\text{anti-noise}_{ll}$ generated by ANC circuit 30, which by convention has the same polarity as the noise in reference microphone signal ref and is therefore subtracted by combiner 26B. Combiner 26B also combines an attenuated portion of near speech signal ns, i.e., sidetone low-frequency information $st_l$.

Figure 3:
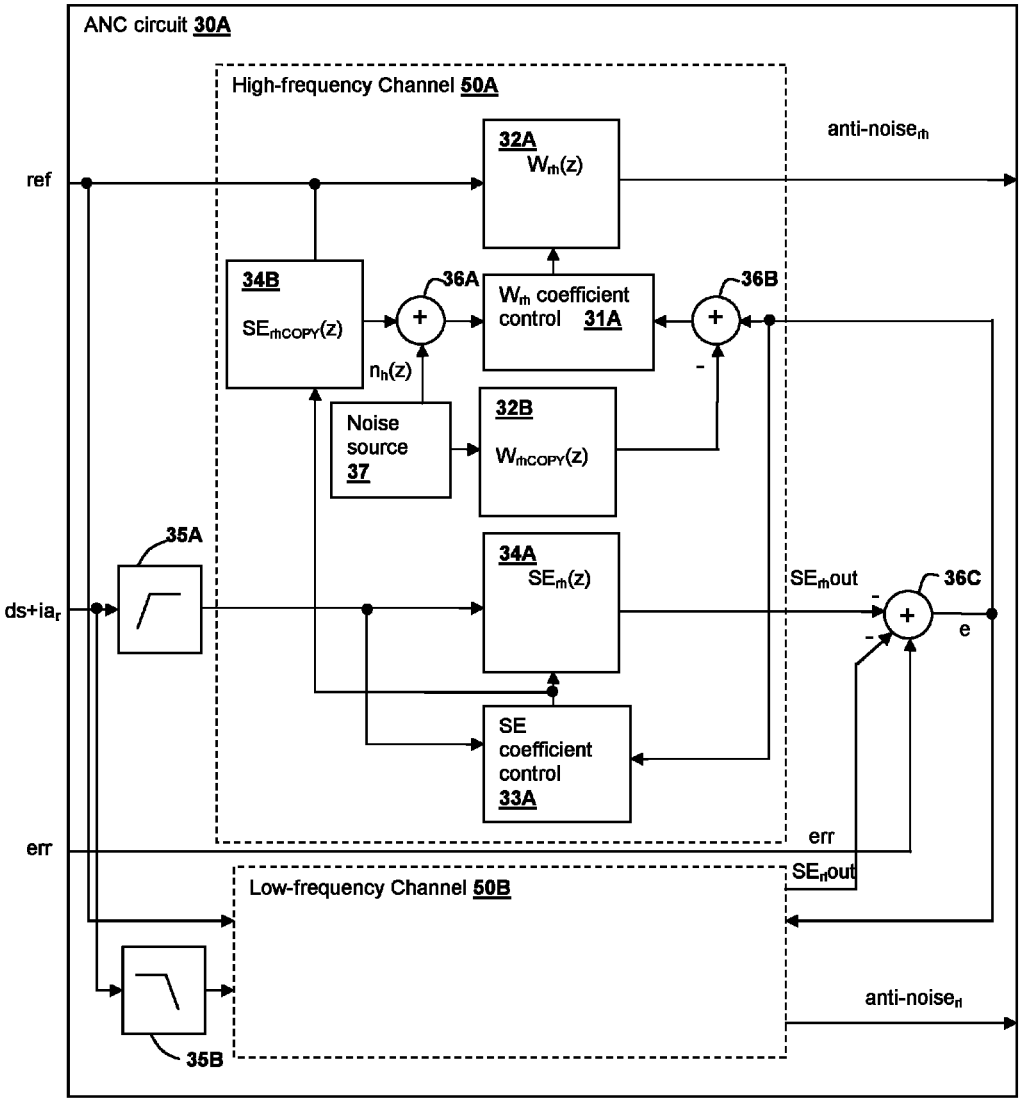
FIG. 3 is a block diagram depicting signal processing circuits and functional blocks of various exemplary ANC circuits that can be used to implement ANC circuit 30 of CODEC integrated circuit 20A of FIG. 2.

Referring now to FIG. 3, an example of details within ANC circuit 30 are shown, and as may be used to implement audio integrated circuit 20B of FIG. 2. An identical circuit is used to implement audio integrated circuit 20A, with changes to the channel labels within the diagram as noted below. A high-frequency channel 50A and a low-frequency channel 50B are provided, for generating anti-noise signals $\text{anti-noise}_{rh}$ and $\text{anti-noise}_{rl}$, respectively. In the description below, where signal and response labels contained the letter "r" indicating the right channel, the letter would be replaced with "l" to indicate the left channel in another circuit according to FIG. 3 as implemented within audio integrated circuit 20A of FIG. 2. Where signals and responses are labeled with the letter "h" for low-frequency in high-frequency channel 50A, the corresponding elements in low-frequency channel 50B would be replaced with signals and responses labeled with the letter "l". An adaptive filter 32A receives reference microphone signal ref and under ideal circumstances, adapts its transfer function $W_{rh}(z)$ to be $P_r(z)/S_{rh}(z)$ to generate anti-noise signal $\text{anti-noise}_{rh}$. The coefficients of adaptive filter 32A are controlled by a W coefficient control block 31A that uses a correlation of two signals to determine the response of adaptive filter 32A, which generally minimizes, in a least-mean squares sense, those components of reference microphone signal ref that are present in error microphone signal err. While the example disclosed herein uses an adaptive filter 32A, connected in a feed-forward configuration, the techniques disclosed herein can be implemented in a noise-canceling system having fixed or programmable filters, where the coefficients of adaptive filter 32A are pre-set, selected or otherwise not continuously adapted, and also alternatively or in combination with the fixed-filter topology, the techniques disclosed herein can be applied in feedback ANC systems or hybrid feedback/feed-forward ANC systems. The signals provided as inputs to W coefficient control block 31A are the reference microphone signal ref as shaped by a copy of an estimate of the response of path $S_{rh}(z)$ provided by a filter 34B and another signal provided from the output of a combiner 36C that includes error microphone signal err. By transforming reference microphone signal ref with a copy of the estimate of the response of path $S_{rh}(z)$, $SE_{rhCOPY}(z)$, and minimizing the portion of the error signal that correlates with components of reference microphone signal ref, adaptive filter 32A adapts to the desired response of $P_r(z)/S_{rh}(z)$.

In addition to error microphone signal err, the other signal processed along with the output of filter 34B by W coefficient control block 31A includes an inverted amount of the source audio $(ds+ia_r)$ including downlink audio signal ds and internal audio ian processed by a secondary path filter 34A having response $SE_{rh}(z)$, of which response $SE_{rhCOPY}(z)$ is a copy. Source audio $(ds+ia_r)$ is first filtered before being provided to high-frequency channel 50A by a high-pass filter 35A, which passes only the frequencies to be rendered by the high-frequency transducer SPKLH or SPKRH. Similarly, the source audio $(ds+ia_r)$ provided to low-frequency channel 50B is first filtered by a low-pass filter 35B, which passes only frequencies to be rendered by the low-frequency transducer SPKLL or SPKRL. Thus, high-pass filter 35A and low-pass filter 35B form a crossover with respect to source audio $(ds+ia_r)$, so that only the appropriate frequencies are passed to high-frequency channel 50A and low-frequency channel 50B, respectively, and having bandwidths appropriate to respective transducers SPKLH, SPKLL or SPKRH, SPKRL. By injecting an inverted amount of source audio $(ds+ia_r)$ that has been filtered by response $SE_{rh}(z)$, adaptive filter 32A is prevented from adapting to the relatively large amount of source audio present in error microphone signal err. By transforming the inverted copy of source audio $(ds+ia_r)$ with the estimate of the response of path $S_{rh}(z)$, the source audio that is removed from error microphone signal err before processing should match the expected version of source audio $(ds+ia_r)$ reproduced at error microphone signal err. The source audio amounts match because the electrical and acoustical path of $S_{rh}(z)$ is the path taken by source audio $(ds+ia_r)$ to arrive at error microphone E. Filter 34B is not an adaptive filter, per se, but has an adjustable response that is tuned to match the response of secondary path adaptive filter 34A, so that the response of filter 34B tracks the adapting of secondary path adaptive filter 34A. To implement the above, secondary path adaptive filter 34A has coefficients controlled by an SE coefficient control block 33A. Secondary path adaptive filter 34A processes the low or high-frequency source audio $(ds+ia_r)$ to provide a signal representing the expected source audio delivered to error microphone E. Secondary path adaptive filter 34A is thereby adapted to generate a signal from source audio (ds+ia$_r$), that when subtracted from error microphone signal err, forms an error signal e containing the content of error microphone signal err that is not due to source audio (ds+ia$_r$). Combiner 36C removes the filtered source audio (ds+ia$_r$) from error microphone signal err to generate the above-described error signal e.

Each of the high-frequency channel 50A and low-frequency channel 50B can operate independently to generate respective anti-noise signals anti-noise$_h$ and anti-noise$_l$. However, since error signal e and reference microphone signal ref may contain frequencies of any frequency in the audio band, without band-limiting anti-noise signals anti-noise$_h$ and anti-noise$_l$, they may contain components that should not be sent to their respective high- and low-frequency transducers SPKRH/SPKLH and SPKRL/SPKLL. Therefore, a noise injection technique is used to control the response $W_{rh}(z)$ of adaptive filter 32A. A noise source 37 generates an output noise signal $n_h(z)$ that is supplied to a copy $W_{rhCOPY}(z)$ of the response $W_{rh}(z)$ of adaptive filter 32A provided by an adaptive filter 32B. A combiner 36A adds noise signal $n_h(z)$ to the output of adaptive filter 34B that is provided to W coefficient control 31A. Noise signal $n_h(z)$, as shaped by filter 32B, is subtracted from the output of combiner 36C by a combiner 36B so that noise signal $n_h(z)$ is asymmetrically added to the correlation inputs to W coefficient control 31A, with the result that the response $W_{rh}(z)$ of adaptive filter 32A is biased by the completely correlated injection of noise signal $n_h(z)$ to each correlation input to W coefficient control 31A. Since the injected noise appears directly at the reference input to W coefficient control 31A, does not appear in error microphone signal err, and only appears at the other input to W coefficient control 31A via the combining of the filtered noise at the output of filter 32B by combiner 36B, W coefficient control 31A will adapt $W_{rh}(z)$ to attenuate the frequencies present in $n_h(z)$. The content of noise signal $n_h(z)$ does not appear in the anti-noise signal, only in the response $W_{rh}(z)$ of adaptive filter 32A which will have amplitude decreases at the frequencies/bands in which noise signal $n_h(z)$ has energy.

In order to prevent low-frequencies from being generated in anti-noise signal anti-noise$_h$, noise source 37 generates noise having a spectrum that has energy in the low-frequency bands, which will cause W coefficient control 31A to decrease the gain of adaptive filter 32A in those low frequency bands in an attempt to cancel the apparent source of ambient acoustic sound due to injected noise signal $n_h(z)$. For example, a white noise source could be filtered by a response similar to the response of low-pass filter 35B for use as noise source 37 in high-frequency channel 50A, which will cause adaptive filter 32A to have low gain in the regions of the pass-band of low-pass filter 35B, By doing the same for low-frequency channel 50B, i.e. filtering a white noise source with a response matching the response of high-pass filter 35A, a cross-over is effectively formed by the adaptation of adaptive filters 32A in high-frequency channel 50A and low-frequency channel 50B that prevents undesirable frequencies in respective anti-noise signals anti-noise$_h$ and anti-noise$_l$. A similar construct could be formed around secondary path adaptive filter 34A, but since the input to secondary path adaptive filter 34A is already filtered by a respective one of filters 35A, 35B to remove out-of-band energy, such noise injection should not be needed to remove undesirable frequencies from the output of secondary path adaptive filter 34A. One advantage of using noise-injection, rather than additional filtering, to remove undesirable cross-over energy from anti-noise signals anti-noise$_h$ and anti-noise$_l$ is that additional latency is not introduced other than any latency due to the change in response due to noise source 37.

Figure 4:
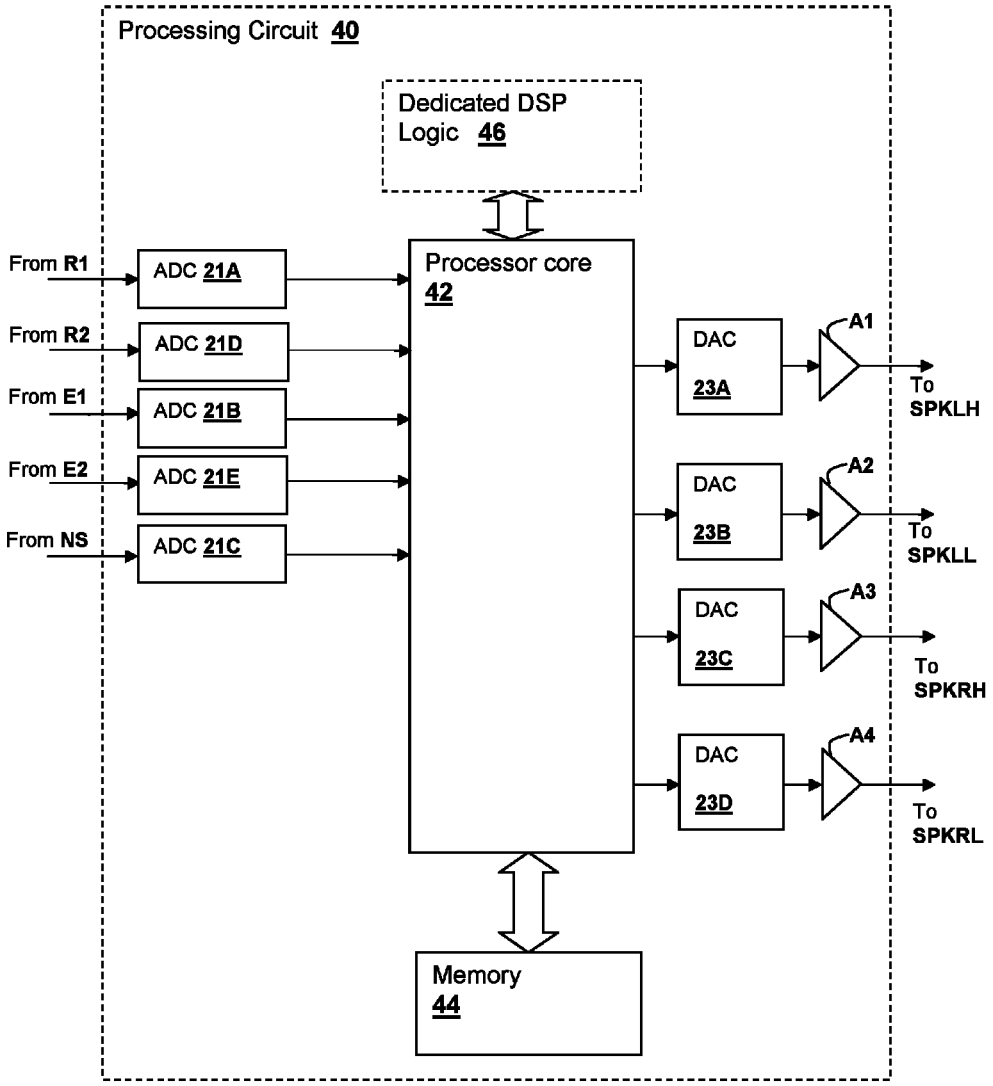
FIG. 4 is a block diagram depicting signal processing circuits and functional blocks within CODEC integrated circuit 20.

Referring now to FIG. 4, a block diagram of an ANC system is shown for implementing ANC techniques as depicted in FIG. 3 and having a processing circuit 40 as may be implemented within audio integrated circuits 20A, 20B of FIG. 2, which is illustrated as combined within one circuit, but could be implemented as two or more processing circuits that inter-communicate. Processing circuit 40 includes a processor core 42 coupled to a memory 44 in which are stored program instructions comprising a computer program product that may implement some or all of the above-described ANC techniques, as well as other signal processing. Optionally, a dedicated digital signal processing (DSP) logic 46 may be provided to implement a portion of, or alternatively all of, the ANC signal processing provided by processing circuit 40. Processing circuit 40 also includes ADCs 21A-21E, for receiving inputs from reference microphone R1, error microphone E1, near speech microphone NS, reference microphone R2, and error microphone E2, respectively. In alternative embodiments in which one or more of reference microphone R1, error microphone E1, near speech microphone NS, reference microphone R2, and error microphone E2 have digital outputs or are communicated as digital signals from remote ADCs, the corresponding ones of ADCs 21A-21E are omitted and the digital microphone signal(s) are interfaced directly to processing circuit 40. DAC 23A and amplifier A1 are also provided by processing circuit 40 for providing the transducer output signal to transducer SPKLH, including anti-noise as described above. Similarly, DACs 23B-23D and amplifiers A2-A4 provide other transducer output signals to transducer pairs SPKLH, SPKLL, SPKRH and SPKRL. The transducer output signals may be digital output signals for provision to modules that reproduce the digital output signals acoustically.

While the invention has been particularly shown and described with reference to the preferred embodiments thereof, it will be understood by those skilled in the art that the foregoing and other changes in form, and details may be made therein without departing from the spirit and scope of the invention.

What is claimed is:

1. A personal audio system, comprising:

a source of audio for reproduction, wherein the source of audio provides a source audio signal;

a first transducer for reproducing high-frequency content of the source audio signal for playback to a listener and a first anti-noise signal for countering the effects of ambient audio sounds in an acoustic output of the first transducer, wherein the first transducer is a high-frequency transducer of an earspeaker;

a second transducer for reproducing low-frequency content of the source audio signal for playback to the listener and a second anti-noise signal for countering the effects of ambient audio sounds in an acoustic output of the second transducer, wherein the second transducer is a low-frequency transducer of the earspeaker;

a third transducer for reproducing high-frequency content of a second source audio signal and a third anti-noise signal for countering the effects of ambient audio sounds in an acoustic output of the third transducer;

a fourth transducer for reproducing low-frequency content of the second source audio signal and a fourth anti-noise signal for countering the effects of ambient audio sounds in an acoustic output of the fourth transducer;

at least one microphone for providing at least one microphone signal indicative of the ambient audio sounds; and a processing circuit that generates the first anti-noise signal from the at least one microphone signal using a first adaptive filter to reduce the presence of the ambient audio sounds at the first transducer and the second transducer in conformity with the at least one microphone signal, wherein the processing circuit generates the second anti-noise signal from the at least one microphone signal using a second adaptive filter to reduce the presence of the ambient audio sounds at the first transducer and the second transducer in conformity with the at least one microphone signal, wherein the processing circuit restricts content of the first anti-noise signal to a first predetermined frequency range by limiting a first frequency response of the first adaptive filter to the first predetermined frequency range, and wherein the processing circuit restricts content of the second anti-noise signal to a second predetermined frequency range by limiting a second response of the second adaptive filter to a second predetermined frequency range, wherein the first predetermined frequency range and the second predetermined frequency range are substantially different, and wherein the processing circuit further generates the third anti-noise signal and the fourth anti-noise signal from the at least one microphone signal using a third filter to reduce the presence of the ambient audio sounds at the third transducer in conformity with the at least one microphone signal, wherein the processing circuit generates the fourth anti-noise signal from the at least one microphone signal using a fourth filter to reduce the presence of the ambient audio sounds at the fourth transducer in conformity with the at least one microphone signal.

2. The personal audio device of claim 1, wherein the at least one microphone comprises:

an error microphone for providing an error microphone signal indicative of the ambient audio sounds and acoustic outputs of the first transducer and the second transducer; and a reference microphone for providing a reference microphone signal indicative of the ambient audio sounds, wherein the first adaptive filter has a first coefficient generator that adapts to minimize components of the reference microphone signal present in the error microphone signal, and wherein the processing circuit restricts adaptation of the first frequency response by altering the frequency content of a first signal input to the first coefficient generator, and wherein the second adaptive filter has a second coefficient generator that adapts to minimize components of the reference microphone signal present in the error microphone signal, and wherein the processing circuit restricts adaptation of the first frequency response by altering the frequency content of a second signal input to the second coefficient generator.

3. The personal audio device of claim 2, wherein the processing circuit alters the frequency content of the first signal input to the first coefficient generator by injecting a first additional signal having first predetermined frequency content in the first predetermined frequency range into the first signal input to the first coefficient generator, and wherein the processing circuit alters the frequency content of the second signal input to the second coefficient generator by injecting a second additional signal having second predetermined frequency content in the second predetermined frequency range into the second signal input to the second coefficient generator.

4. The personal audio device of claim 3, wherein the first additional signal and the second additional signal are noise signals.

5. A method of countering effects of ambient audio sounds by a personal audio system, the method comprising:

measuring ambient audio sounds with at least one microphone to produce at least one microphone signal;

first generating a first anti-noise signal from the at least one microphone signal using a first adaptive filter to reduce the presence of the ambient audio sounds at a first transducer in conformity with the at least one microphone signal, wherein the first generating restricts content of the first anti-noise signal to a first predetermined frequency range by limiting a first frequency response of the first adaptive filter to the first predetermined frequency range, wherein the first transducer is a high-frequency transducer of an earspeaker;

second generating a second anti-noise signal from the at least one microphone signal using a second adaptive filter to reduce the presence of the ambient audio sounds at a second transducer in conformity with the at least one microphone signal, wherein the second generating restricts content of the second anti-noise signal to a second predetermined frequency range by limiting a second frequency response of the second adaptive filter to the second predetermined frequency range wherein the first predetermined frequency range and the second predetermined frequency range are substantially different, wherein the second transducer is a low-frequency transducer of the earspeaker;

providing a source of audio for reproduction, wherein the source of audio provides a source audio signal;

reproducing high-frequency content of the source audio signal and the first anti-noise signal with the first transducer;

reproducing low-frequency content of the source audio signal and the second anti-noise signal with the second transducer;

reproducing high-frequency content of a second source audio signal and a third anti-noise signal with a third transducer for countering the effects of ambient audio sounds in an acoustic output of the third transducer;

reproducing low-frequency content of the second source audio signal and a fourth anti-noise signal with a fourth transducer for countering the effects of ambient audio sounds in an acoustic output of the fourth transducer;

generating the third anti-noise signal and the fourth anti-noise signal from the at least one microphone signal using a third filter to reduce the presence of the ambient audio sounds at the third transducer and the fourth transducer in conformity with the at least one microphone signal; and generating the fourth anti-noise signal from the at least one microphone signal using a fourth filter to reduce the presence of the ambient audio sounds at the third transducer and the fourth transducer in conformity with the at least one microphone signal.

6. The method of claim 5, wherein the measuring the ambient audio sounds is performed with a reference microphone to generate a reference microphone signal, and wherein the method further comprises measuring the ambient audio sounds and acoustic outputs of the first transducer and the second transducer with an error microphone to generate an error microphone signal, wherein the first generating comprises adapting coefficients of a first coefficient generator that controls the first frequency response to minimize components of the reference microphone signal present in the error microphone signal, and wherein the second generating comprises adapting coefficients of a second coefficient generator that controls the second frequency response to minimize components of the reference microphone signal present in the error microphone signal, wherein the first generating restricts adaptation of the first frequency response by altering frequency content of a first signal input to the first coefficient generator, and wherein the second generating restricts adaptation of the second frequency response by altering frequency content of a second signal input to the second coefficient generator.

7. The method of claim 6, wherein the first generating restricts adaptation of the first frequency response by injecting a first additional signal having a first predetermined frequency content in the first predetermined frequency range into at least one first signal input to the first coefficient generator, and wherein the second generating restricts adaptation of the second frequency response by injecting a second additional signal having a second predetermined frequency content in the second predetermined frequency range into at least one second signal input to the second coefficient generator.

8. The method of claim 7, wherein the first additional signal and the second additional signal are noise signals.

9. An integrated circuit for implementing at least a portion of a personal audio system, comprising:

a source of audio for reproduction, wherein the source of audio provides a source audio signal;

a first output for providing a first output signal to a first transducer for reproducing high-frequency content of the source audio signal and a first anti-noise signal for countering the effects of ambient audio sounds in an acoustic output of the first transducer, wherein the first transducer is a high-frequency transducer of an earspeaker;

a second output for providing a second output signal to a second transducer for reproducing low-frequency content of the source audio signal including both second source audio for playback to a listener and a second anti-noise signal for countering the effects of ambient audio sounds in an acoustic output of the second transducer, wherein the second transducer is a low-frequency transducer of the earspeaker;

a third output for providing a third output signal to a third transducer for reproducing high-frequency content of a second source audio signal and a third anti-noise signal for countering the effects of ambient audio sounds in an acoustic output of the third transducer;

a fourth output for providing a fourth output signal to a fourth transducer for reproducing low-frequency content of the second source audio signal and a fourth anti-noise signal for countering the effects of ambient audio sounds in an acoustic output of the fourth transducer;

at least one microphone input for providing at least one microphone signal indicative of the ambient audio sounds; and a processing circuit that generates the first anti-noise signal from the at least one microphone signal using a first adaptive filter to reduce the presence of the ambient audio sounds at the first transducer and the second transducer in conformity with the at least one microphone signal, wherein the processing circuit generates the second anti-noise signal from the at least one microphone signal using a second adaptive filter to reduce the presence of the ambient audio sounds at the first transducer and the second transducer in conformity with the at least one microphone signal, wherein the processing circuit restricts content of the first anti-noise signal to a first predetermined frequency range by limiting a first frequency response of the first adaptive filter to the first predetermined frequency range, and wherein the processing circuit restricts content of the second anti-noise signal to a second predetermined frequency range by limiting a second response of the second adaptive filter to a second predetermined frequency range, wherein the first predetermined frequency range and the second predetermined frequency range are substantially different, and wherein the processing circuit further generates the third anti-noise signal and the fourth anti-noise signal from the at least one microphone signal using a third filter to reduce the presence of the ambient audio sounds at the third transducer and the fourth transducer in conformity with the at least one microphone signal, wherein the processing circuit generates the fourth anti-noise signal from the at least one microphone signal using a fourth filter to reduce the presence of the ambient audio sounds at the third transducer and the fourth transducer in conformity with the at least one microphone signal.

10. The integrated circuit of claim 9, wherein the at least one microphone input comprises a reference microphone input for receiving a reference microphone signal indicative of the ambient audio sounds and further comprises an error microphone input for receiving an error microphone signal indicative of the ambient audio sounds and acoustic outputs of the first transducer and the second transducer, wherein the first adaptive filter has a first coefficient generator that adapts to minimize components of the reference microphone signal present in the error microphone signal, and wherein the processing circuit restricts adaptation of the first frequency response by altering the frequency content of a first signal input to the first coefficient generator, and wherein the second adaptive filter has a second coefficient generator that adapts to minimize components of the reference microphone signal present in the error microphone signal, and wherein the processing circuit restricts adaptation of the first frequency response by altering the frequency content of a second signal input to the second coefficient generator.

11. The integrated circuit of claim 10, wherein the processing circuit alters the frequency content of the first signal input to the first coefficient generator by injecting a first additional signal having a first predetermined frequency content in the first predetermined frequency range into the first signal input to the first coefficient generator, and wherein the processing circuit alters the frequency content of the second signal input to the second coefficient generator by injecting a second additional signal having a second predetermined frequency content in the second predetermined frequency range into the second signal input to the second first coefficient generator.

12. The integrated circuit of claim 11, wherein the first additional signal and the second additional signal are noise signals.

* * * * *